United States Patent [19]

Carey

[11] 3,960,713

[45] June 1, 1976

[54] MEDICATION TIMING SEALING DEVICE

[75] Inventor: Helen L. Carey, Brooklyn, N.Y.

[73] Assignee: The Raymond Lee Organization, Inc., a part interest

[22] Filed: Aug. 16, 1974

[21] Appl. No.: 497,927

[52] U.S. Cl. ..... 206/534; 116/121; 206/459; 215/230; 215/304

[51] Int. Cl.$^2$ ..... B65D 51/24; B65D 85/56; G09F 9/00

[58] Field of Search ..... 116/121; 206/459, 534; 215/206, 224, 230, 304; 220/256

[56] References Cited

UNITED STATES PATENTS

| | | | |
|---|---|---|---|
| 2,739,564 | 3/1956 | North | 116/121 |
| 2,767,680 | 10/1956 | Lermer | 215/230 X |
| 2,953,242 | 9/1960 | Shaw | 206/534 |
| 3,073,468 | 1/1963 | Arneson | 215/230 |
| 3,446,179 | 5/1969 | Bender | 206/534 X |
| 3,561,592 | 2/1971 | McCool | 206/534 |
| 3,739,740 | 6/1973 | Fromer | 116/121 |

*Primary Examiner*—Steven E. Lipman

[57] ABSTRACT

A container of medicine has an open neck. A first cap detachably secured to the neck to enclose same has an outer major surface with indicia thereon. The indicia takes the form of peripherally disposed equidistantly separated numbers from one to twelve inclusive disposed in a complete circle. A second cap of like contour snap fits over the first cap and has a major surface overlying the corresponding surface of the first cap. The second cap surface has a window opening alignable with and exposing to view any selected one of said numbers. The exposed number indicates to the user the time at which the medication is to be taken.

2 Claims, 6 Drawing Figures

MEDICATION TIMING SEALING DEVICE

SUMMARY OF THE INVENTION

This invention is directed toward a medication timing sealing device which can be used to detachably seal the open neck of a container of medicine and which exposes a number identifying the time at which the user is to take the medicine. To this end, the device employs a first cap detachably secured to said neck to enclose same. The first cap has an outer major surface with indicia thereon. The indicia takes the form of peripherally disposed equidistantly separated numbers from 1 to 12 inclusive disposed along a complete circle. A second cap of like contour snap fits over the first cap and has a major surface overlying the corresponding surface of the first cap. The second cap surface has a window opening alignable with and exposing to view any selected one of said numbers. The number so exposed is the time indication required.

DETAILED DESCRIPTION OF PREFERRED EMBODIMENTS

Figure 1:
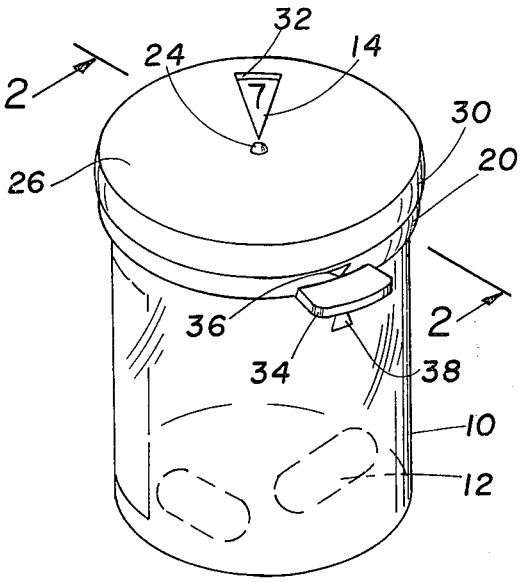
FIG. 1 is a perspective view of one form of the invention.
Figure 2:
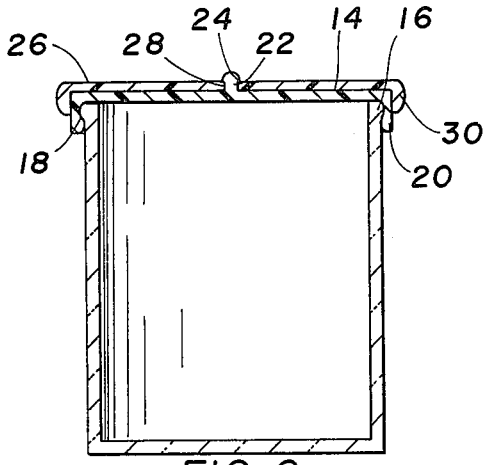
FIG. 2 is a view taken along line 2—2 in FIG. 1.
Figure 3:
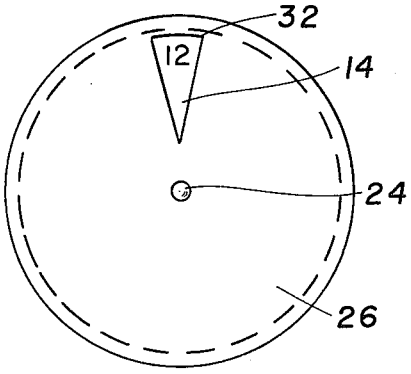
FIG. 3 is a top view of the structure of FIG. 1.

Referring first to FIGS. 1– 3, a container 10 of capsules 12 or other medicine has an open neck detachably sealed by a first cap. This cap has a flat circular major portion with an outer surface 14 having peripherally disposed equidistantly spaced numbers from 1 to 12 inclusive disposed along a complete circle. The neck of the container has an outer lip 16 which snap fits into a corresponding circular groove 18 in a downwardly disposed lip 20 of the first cap. Surface 14 has a centrally disposed vertical post 22 with an enlarged head 24. A second cap of similar contour has a major flat surface 26 with a central opening 28 snap fitting on the post. This cap has a lip 30 engaging the outer surface of lip 20. Surface 26 has a peripherally oriented viewing window 32. The two caps can be relatively oriented to enable any selected number from 1 to 12 described above to be displayed for the purposes indicated. The first cap can have a tab 34 with an aligned arrow 36 on its lip. The container can have an arrow 38 aligned with a peripheral enlargement thereon. When the arrows and tab are aligned, the tab is aligned with the enlargement (the two caps can be rotated as a unit about the neck) to facilitate ease of removal from the container.

The term "snap fit" as used in this specification refers to the conventional method of securing two caps or cylinders together in such manner that the outer cap or cylinder can be rotated relative to the inner cap or cylinder, after the inner cap or cylinder is secured to the neck of a container. Conventionally, the outer diameter of the inner cap or cylinder is slightly smaller than the inner diameter of the outer cap or cylinder as shown in FIG. 6, whereby after the outer cap or cylinder is pushed downward upon the inner cap or cylinder, the two items are engaged and are held together in a friction tight fit which yet permit relative rotation.

Figure 4:
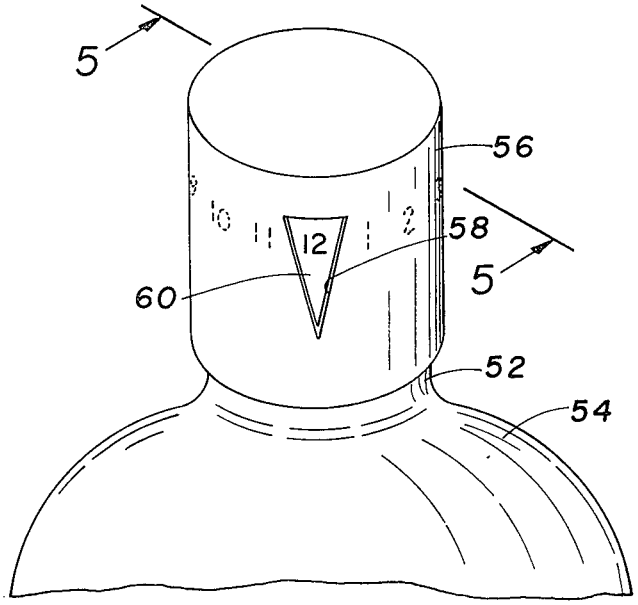
FIG. 4 is a perspective view of another form of the invention.
Figure 5:
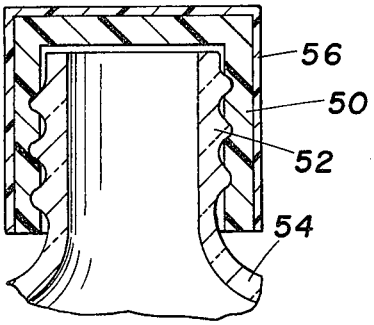
FIG. 5 is a view taken along line 5—5 in FIG. 4.
Figure 6:
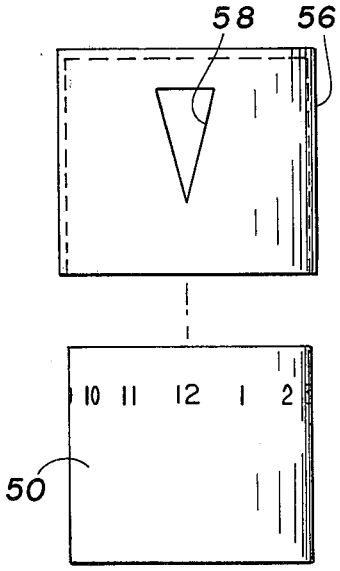
FIG. 6 is an exploded view of a portion of the structure of FIG. 4.

In FIGS. 4–6, the first cap takes the form of a vertical hollow cylinder 50 closed at its top end, open at its bottom end and threadedly and removably screwed to the neck 52 of container 54. The outer cylindrical surface 60 of cylinder 50 carries the numbers from one to twelve inclusive disposed equidistantly about a horizontal surface. A second similar cylinder 56 snap fits over cylinder 50 and has a viewing window 58 aligned with a selected number as before.

While the invention has been described with detailed reference to the drawings, the protection sought is to be limited only by the terms of the claims which follow.

I claim:

1. A medication timing sealing device for a container of medicine having an open neck having an outer thread, said device comprising:

a first vertical hollow cylinder closed at its top end and open at its bottom end, said first cylinder having a thread on its inner cylindrical wall, said first cylinder being threadedly and removably screwed into said neck, said first cylinder having peripherally positioned equidistantly separated numbers from one to twelve disposed along a horizontal circle on the outer cylindrical surface of the first cylinder; and a second vertical hollow cylinder closed at its top end and open at its bottom end, the second cylinder being snap fitted over the first cylinder, the second cylinder having a viewing window in its cylindrical surface which is aligned with and exposes to view any selected one of said numbers.

2. The device of claim 1 wherein said window defines an elongated triangle with a downwardly pointing vertex.

* * * * *